US005388662A

United States Patent [19]

Tranchero

[11] Patent Number: 5,388,662

[45] Date of Patent: Feb. 14, 1995

[54] HOIST MACHINE ASSOCIATED TO A SELF-PROPELLED TRUCK

[76] Inventor: Jacques Tranchero, Via Cerretto, 56, 12024 Costigliole Saluzzo, Cuneo, Italy

[21] Appl. No.: 97,748

[22] Filed: Jul. 28, 1993

[30] Foreign Application Priority Data

Jul. 31, 1992 [IT] Italy ..... 92A 000657

[51] Int. Cl.[6] ..... B66F 11/04

[52] U.S. Cl. ..... 182/63; 182/2

[58] Field of Search ..... 182/2, 63

[56] References Cited

U.S. PATENT DOCUMENTS 3,828,939 8/1974 Tranchero ..... 182/2 X
4,558,758 12/1985 Littman et al. ..... 182/2 X
4,667,771 5/1987 Tranchero ..... 182/2
4,770,271 9/1988 Tranchero ..... 182/2

FOREIGN PATENT DOCUMENTS 2120633 12/1983 United Kingdom ..... 182/2

*Primary Examiner*—Alvin C. Chin-Shue
*Attorney, Agent, or Firm*—Levine & Mandelbaum

[57] ABSTRACT

Hoist machine for aerial platforms (18) associated to self-propelled trucks (1), comprising a system of articulated levers constituting four lifting stages activated by three hydraulic jacks (5, 10, 16); the terminal stage being connected to a platform provided with driving means for the control of the positions and functions and of the truck and of the lifting stages.

10 Claims, 9 Drawing Sheets

HOIST MACHINE ASSOCIATED TO A SELF-PROPELLED TRUCK

The Applicant is the owner of Italian patents Nos. 1,154,479, 1,187,983 and 1,217,156.

BACKGROUND OF THE INVENTION

These patents disclose hoist machines which can be mounted onto motor vehicles; they are provided with platforms or nacelles suitable for carrying persons or differing loads and which can be raised to prefixed heights of a maximum limit, for the different machines, varying from 20 m to 50 m.

These machines comprise three or four stages of acticulated levers which are activated by hydraulic cylinders. They are mounted on platforms which can be rotated more than 360° around a vertical axis and are able to take the terminal nacelle to considerable heights thus allowing various kinds of work to be carried out. They are structurally stable, while the aerial nacelle is able to take up prominent overhang positions with respect to the base of the machine and can, for example, be positioned in space so as to be brought near to points on buildings and aerial electric lines which cannot be reached by other means. Thanks to their characteristic versatility, these machines have found use to a vast extent world wide. Prior Art machines, mounted on suitable motor vehicles, also when they are completely retracted, i.e. in the rest position with respect to the base platform, and the support motor vehicle, require a space that is very wide to make them suitable for work to be carried out at considerable heights. They cannot be used in environments defined by walls, such as, for example, exhibition halls, museums and the like.

SUMMARY OF THE INVENTION

The subject of the present invention is a hoist machine mounted on a self-propelled truck, capable of carrying a platform with persons and various materials to a considerable height, 20 m and more.

The machine comprises three hydraulic cylinders, four lifting stages constituted by parallelograms of levers with a boxed structure and variable geometry, formed from sheet steel, mutually articulated, shaped in such a way that the parallelograms of some of the levers, when the machine is retracted in the Pest position, are contained within the perimeter of other parallelograms of levers so that the machine and its relative truck take up the minimum space possible in height when the relative platform is in the rest position.

The self-propelled truck also contributes to economy of space in height when the machine is lowered. The truck has a frame supported by wheels of small diameter propelled by a suitable motor. Each pair of wheels is associated with a modular group which can be replaced by another group having components of different sizes and working characteristics.

The special characteristics of the machine and its truck are set forth in the patent claims. The description that follows refers to the illustrative drawings which vary in scale. Some illustrate the overall machine; others illustrate particulars of the machine, in elevation, in plan or in axonometric views.

DESCRIPTION OF THE DRAWINGS

FIG. 14, 14A and 14B, represent on a side view rotated at 90° around its longitudinal axis, of one of the branches of a frame, having a parallelepiped structure, articulated to the terminal stage of the machine;

DESCRIPTION OF THE PREFERRED EMBODIMENT

Figure 1:
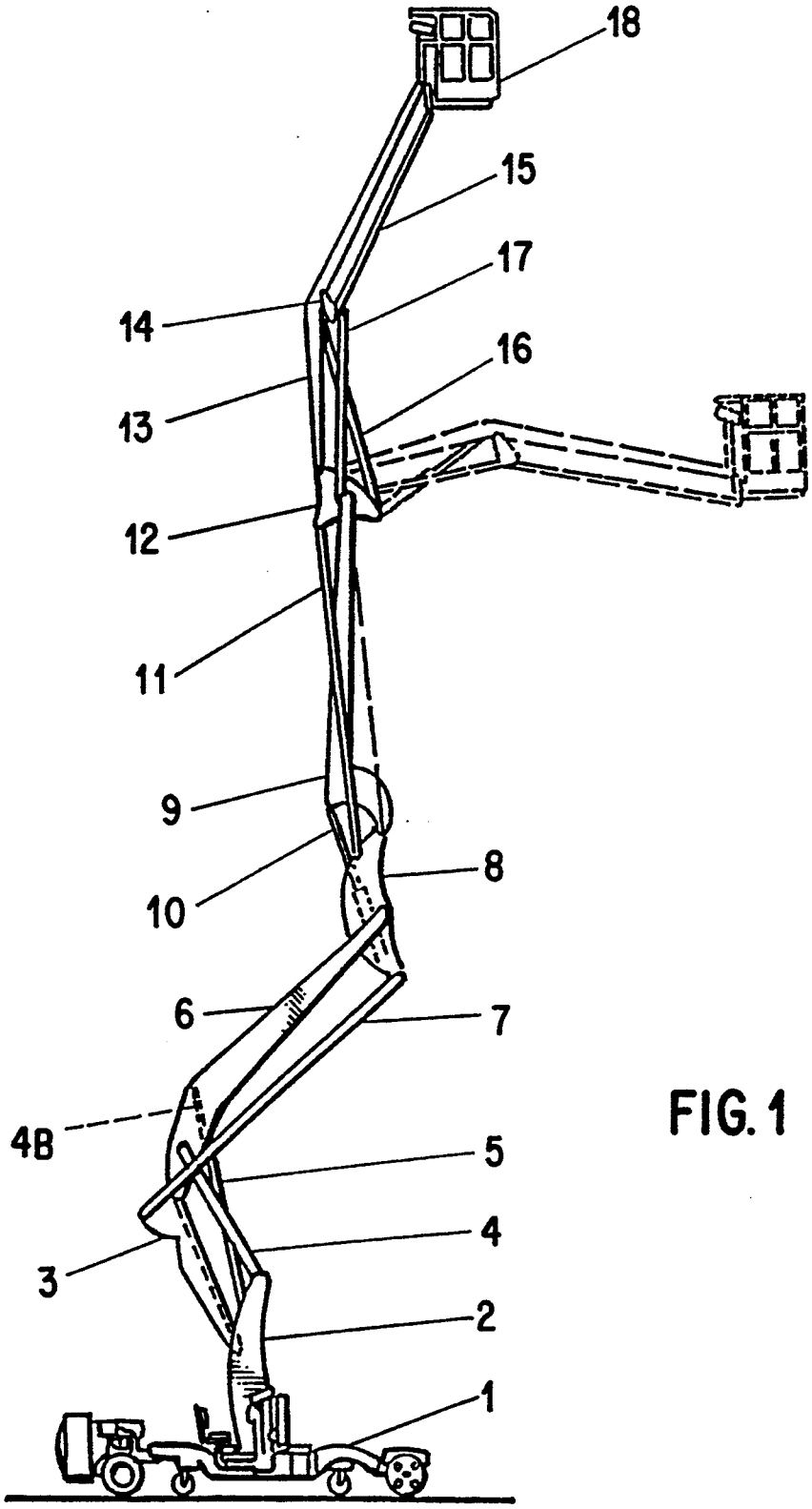
FIG. 1 is a side view of the base truck and of the machine, with the platform in the position of maximum elevation.
Figure 14A:
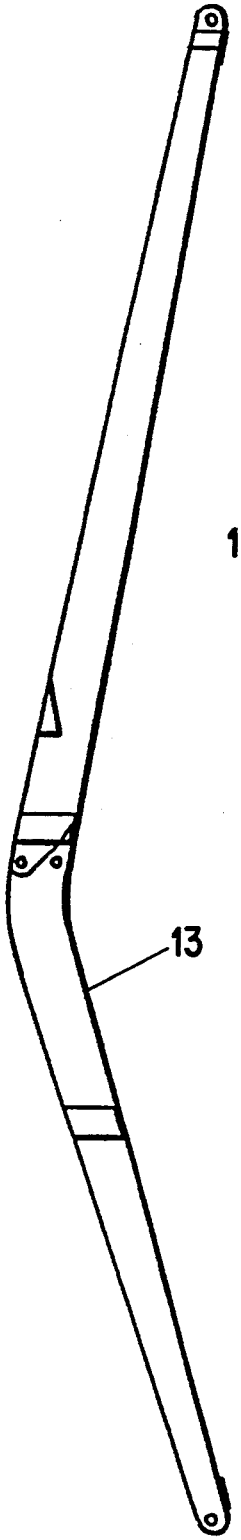
Figure 14B:
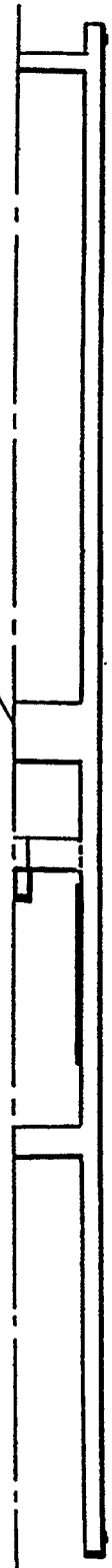
Figure 15A:
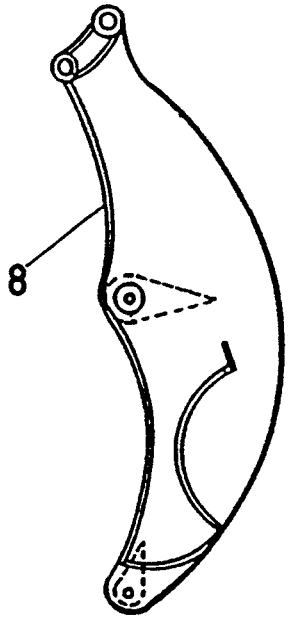
FIG. 15, -15A- and -15B- respectively are views, as in the preceding figure, of a frame, hereunder called a "crib"
Figure 15B:
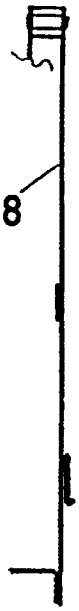
Figure 16A:
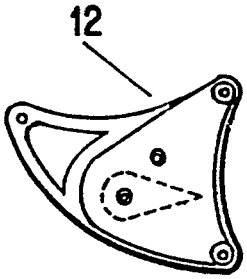
FIG. 16, -16A- and -16B- respectively, as in FIGS. 14 and 15, are views of a particular which is hereunder called a "counter-crib".
Figure 16B:
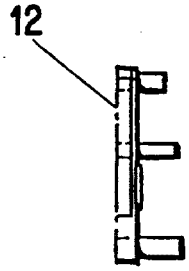

In FIG. 1, 1 indicates the truck which supports the entire machine; 2 indicates a turret which revolves on a bearing disc fixed to the truck 1. One end of the following are hinged to this turret: a connecting rod 3, a lever 4 and a jack or hydraulic cylinder 5. The opposite end of the jack 5 is hinged to an angled lifting arm. The other end of the connecting rod 3 is hinged to one end of the arm 6. The other end of the lever 4 is hinged to a point of the arm 6, at an intermediate position, between the hinge of the jack 5 and the hinge of the connecting rod 3. A tie rod 7 has one end hinged to a section 3*a* of a lever 3, while the opposite end is hinged to the frame 8, called a "crib", illustrated in detail in FIG. 15. A radial arm 9 is hinged to the crib 8, the arm 9 being activated by a jack 10, see FIGS. 1, 2, the latter being hinged to the lower and of the crib 8. A tie rod 11 is hinged to the crib 8 and to the counter-crib 12. Another end of the radial arm 9 is also hinged to the counter-crib 12. One end of an angled lever 13 is also hinged to the counter-crib 12, as illustrated in FIG. 14, its opposite end being hinged to a platform 18. A hydraulic jack 16, hinged to the counter-crib 12 engages an intermediate point on the terminal lever 13.

The control of the horizontal position of the loading base of the platform 18 is carried out using two pairs of bars 15, 17. One end of the bars 15 is hinged to the counter-crib 12; one end of the bars 17 is hinged to the platform 18; the opposite ends of both pairs of bars 15, 17 are hinged to a return device 14, FIG. 3, which is in turn hinged to the lever 13.

Figure 5:
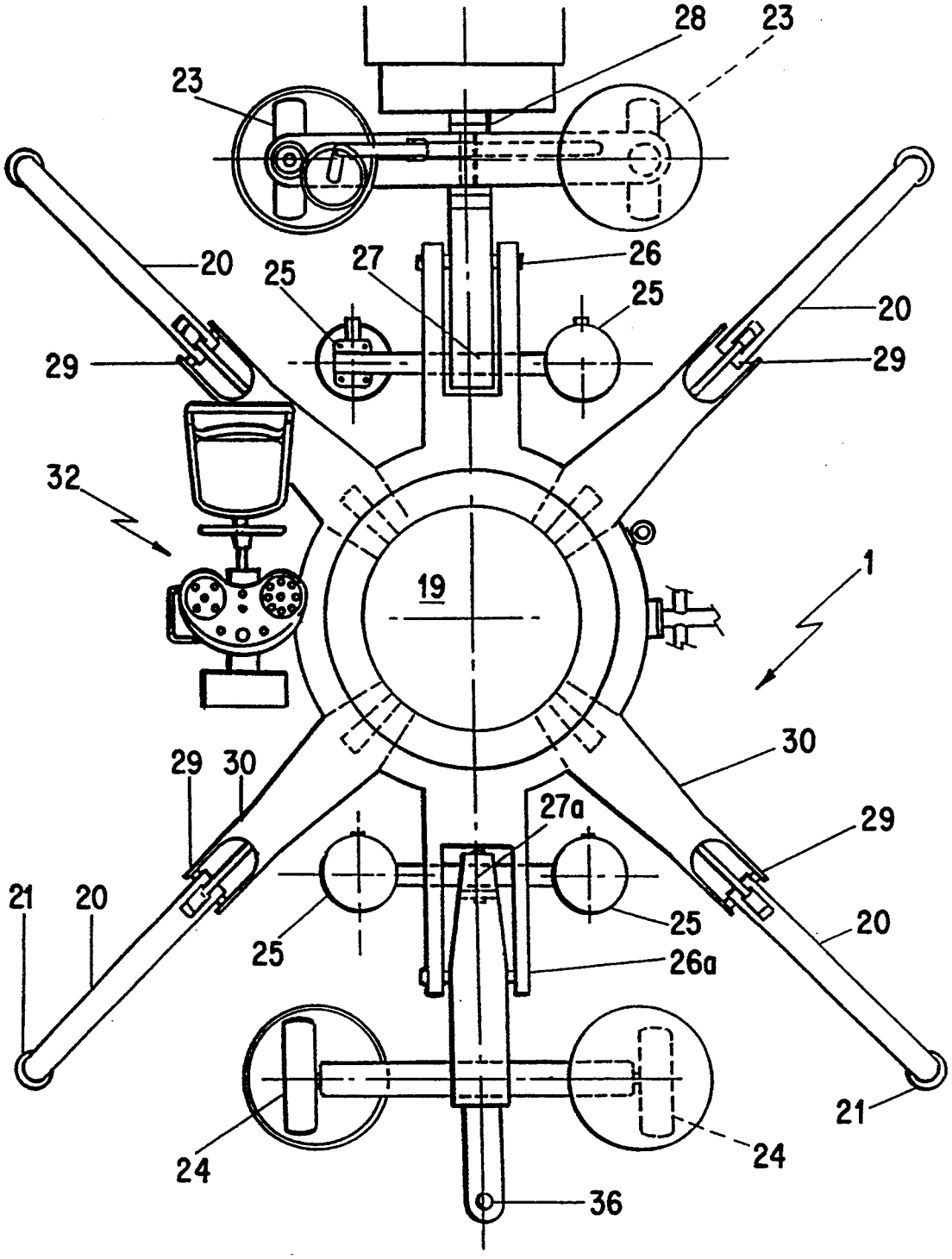
FIG. 5 is a plan view of the truck.

The bearing disc on which the turret 2 is mounted for revolving, FIG. 5, is fixed to the central base 19 of the truck 1, which is provided with four radial stabilizing arms 20 having terminal anti-slide means 21.

With reference to FIGS. 1 through 4, the truck 1, shown in plan view in FIG. 5, has a central frame and bearing disc 19 which supports the revolving turret 2 and is provided with a propelling unit 22, such as a hydraulic power plant, or any other type of motor capable of transmitting rotary movement to front and guiding bearing wheels 23 and back bearing wheels 24. Reference number 25 indicates two pairs of pivoting wheels associated with front hinged balancing means 26, 27, 28, with three degrees of freedom, and back balancing means 26*a*, 27*a* with two degrees of freedom, and for the best possible distribution of the weight of the machine, particularly when the truck is working on wood floors, or floors of any other deteriorative material.

The propelling unit 22 and the driven unit, with the wheels 23, are modular and easily interchangeable, according to the type and conditions of the ground to be covered by the truck 1.

The truck 1 has a platform 19, modular groups 23, 24 and 25 and radial arms 20, hinges 29 and terminal anti-slide elements 21.

Figure 12:
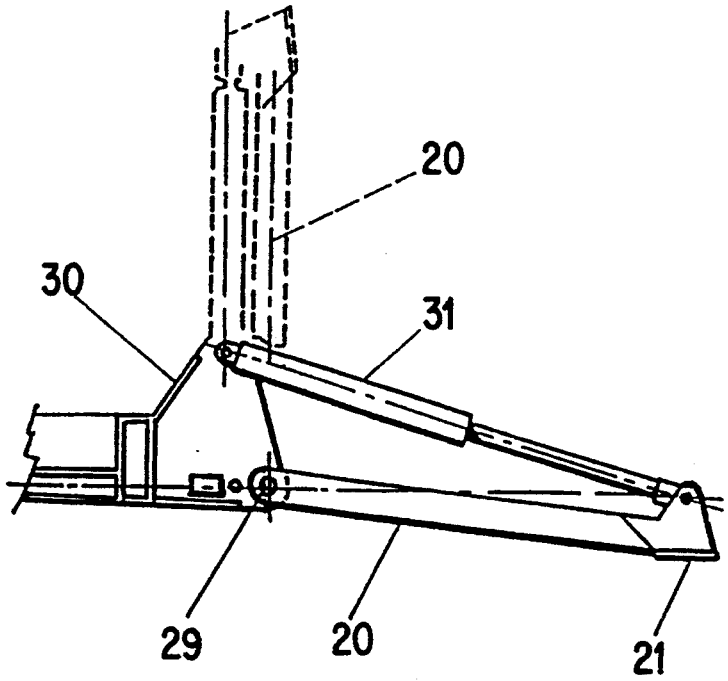
FIGS. 12 and 13 are side views of two different structures of one of the four radial arms and stabilizers of the truck.
Figure 13:
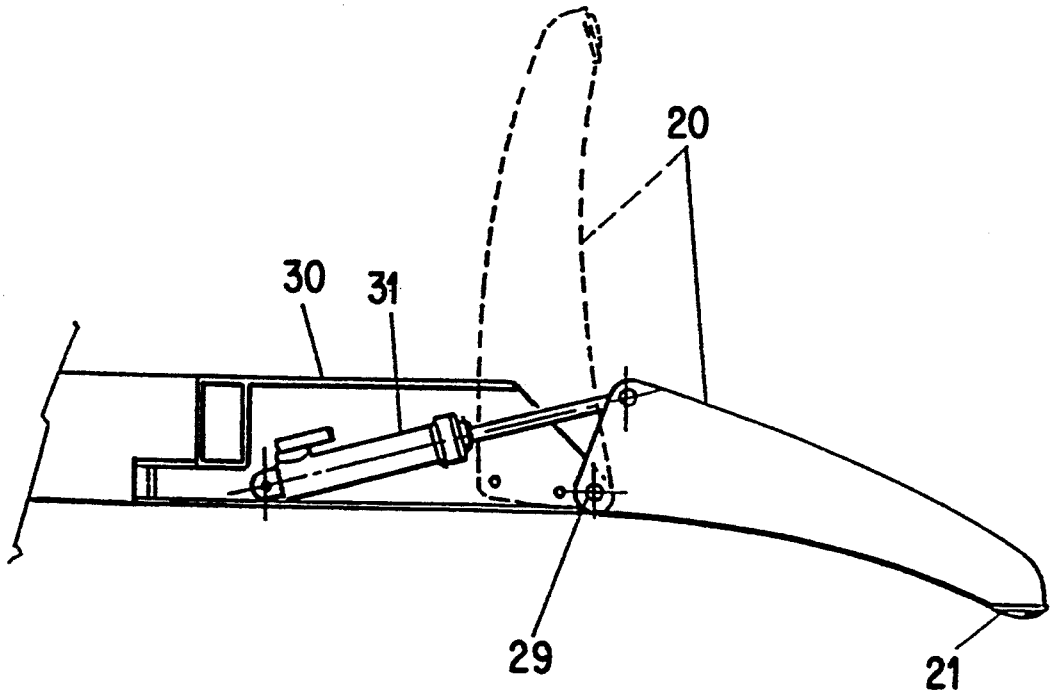

As shown in detail in FIGS. 12 and 13, the radial arms 20 are connected via hinges 29 to projections 30 fixed to the platform 19. Each arm 20 is associated with a jack 31. As illustrated in FIG. 12, the hydraulic cylinder 31 interacts with the fixed projection 30 and the free end of the corresponding arm 20 which can occupy a lowered position, illustrated by continuous lines, or a rest position, illustrated by broken lines.

In the variant according to FIG. 13, the hinged arm 20 has a different structure, and the jack 31 is applied to the end of the arm 20 near to its joint. With this second solution, when the arm 20 is in the rest position, the jack 31 is housed in the boxed body of the projection 30.

The structural characteristics and the sizes of the radial arms 20, as shown in FIGS. 12 and 13, are chosen according to the size of the truck 1. If the truck 1 is large, it is provided with radial arms according to FIG. 13; if the size of the truck is smaller, it is provided with radial arms as shown in FIG. 12.

Figures 3A, 3B:
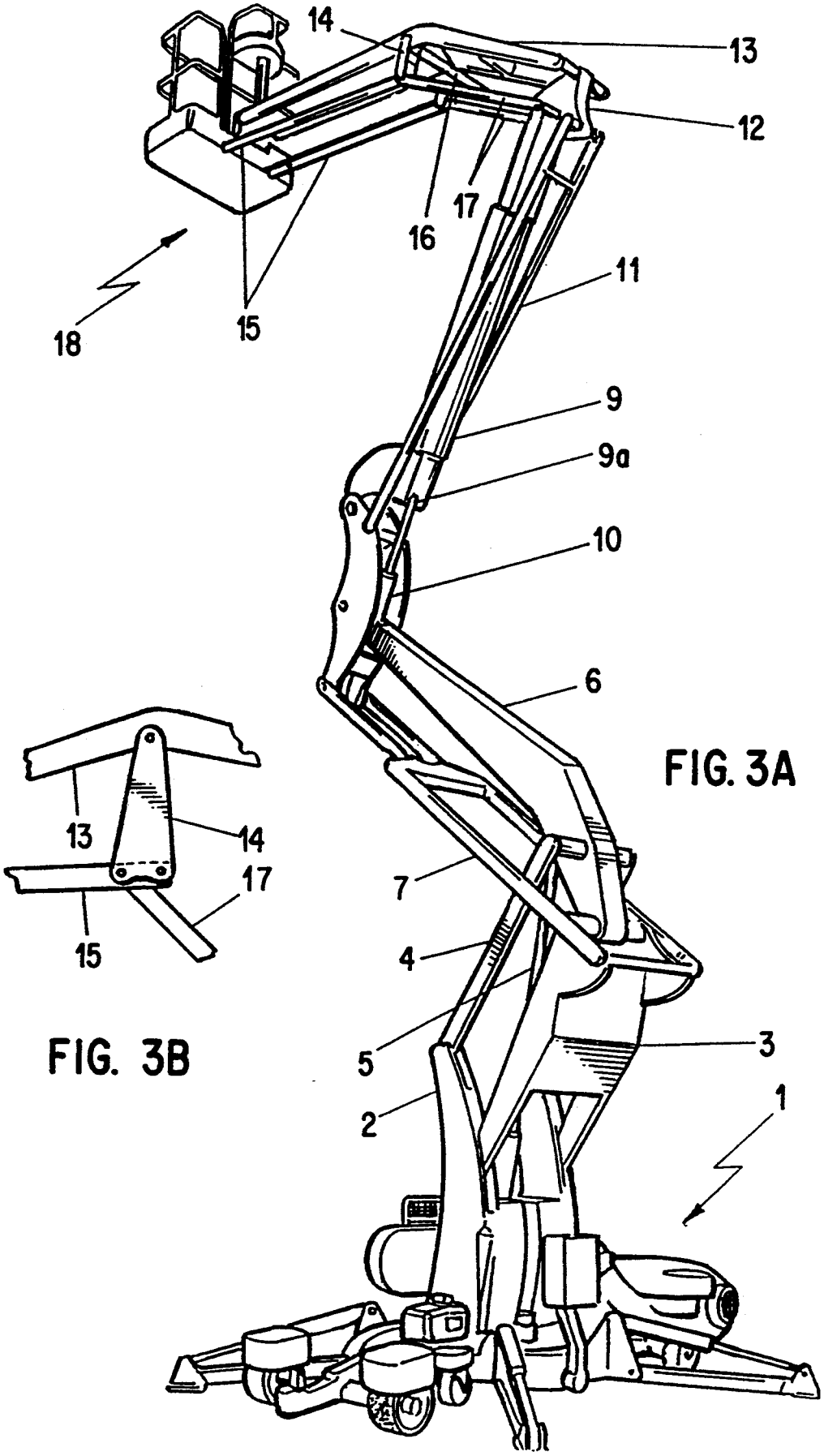
FIGS. 3A and 3B show an axonometric view of the machine, with the platform in a partially raised position.
Figure 8:
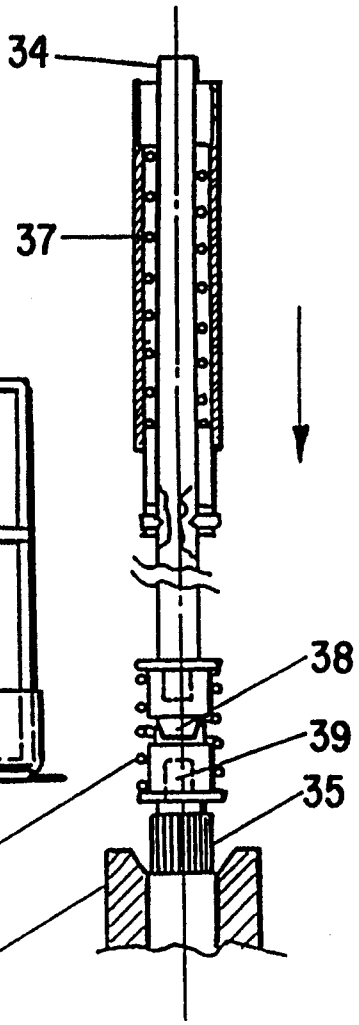
FIG. 8, on a different scale, illustrates a particular of the platform control components.
Figure 7:
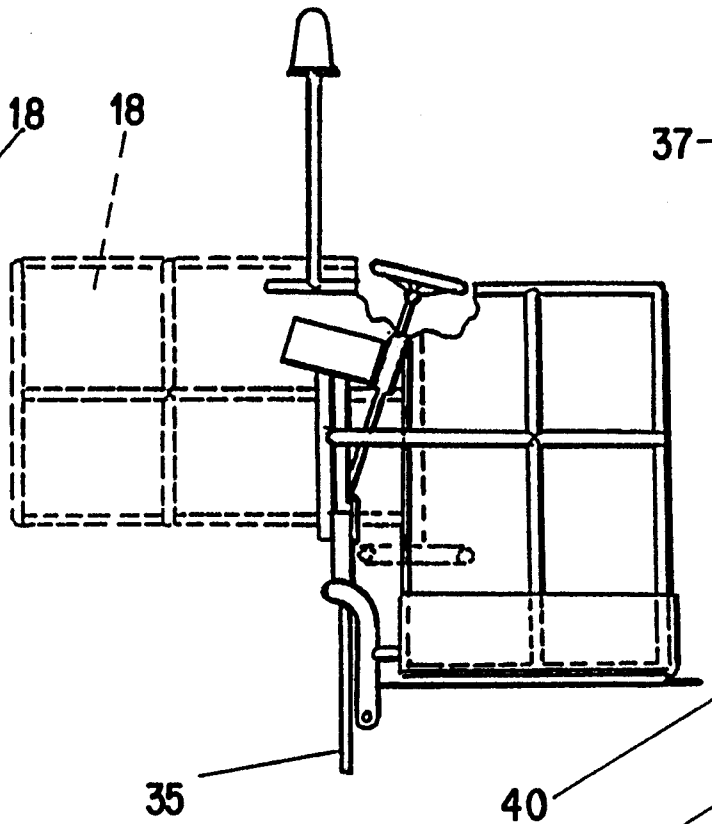
FIG. 7 is a side view of the aerial platform.

The pairs of guiding wheels 23 and back wheels 24 have a steering angle of 90°, in either direction, when controlled from the driving position 32, FIG. 5, which can be fitted on the truck, or the platform 18, see FIGS. 3, 7, 8.

Preferably, the driving position is on the platform although the machine may be provided with two driving positions, one on the truck and the other on the platform.

Figure 2:
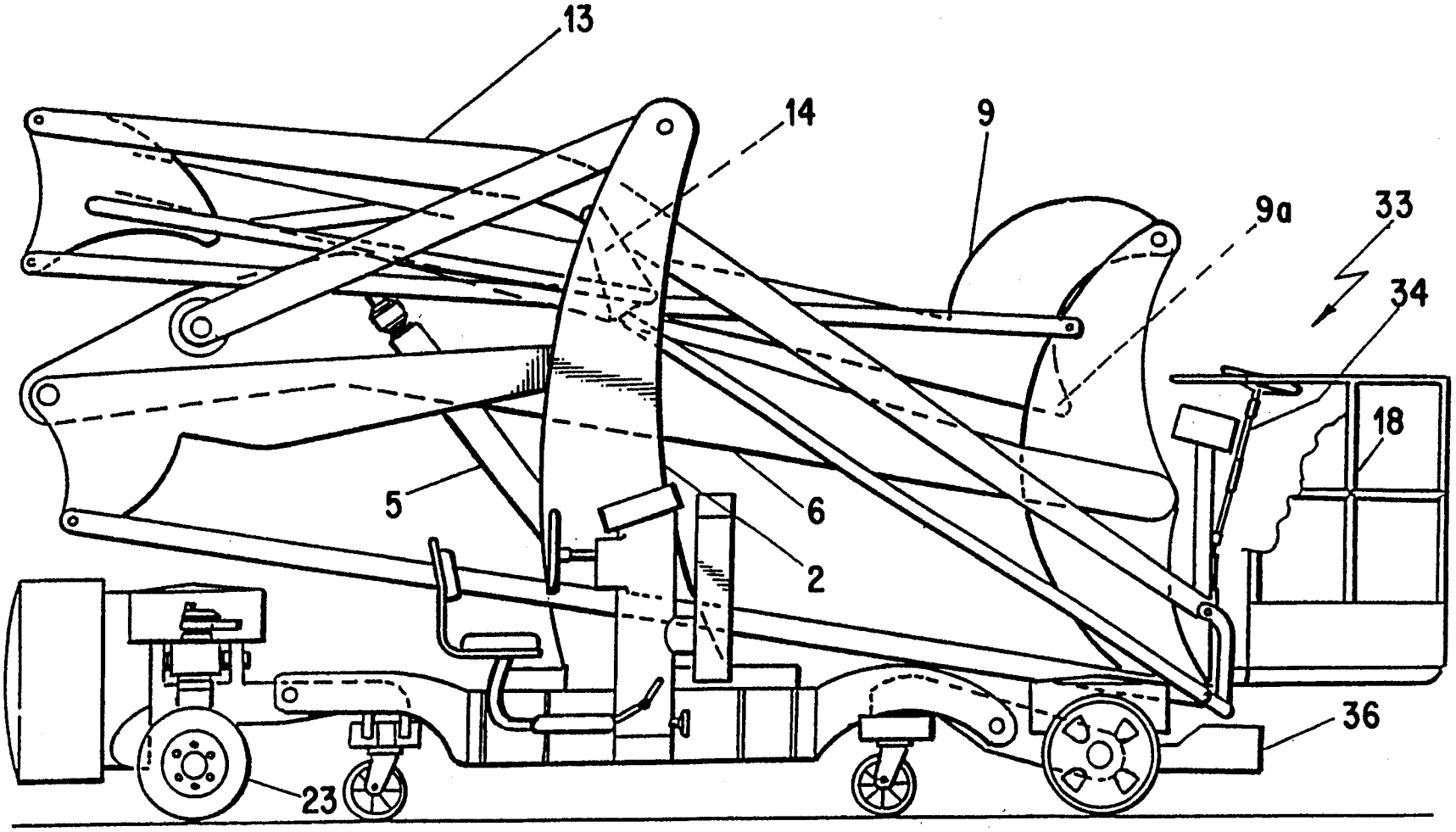
FIG. 2, on a different scale, illustrates the same machine, in the rest position, lowered onto the truck.
Figure 6:
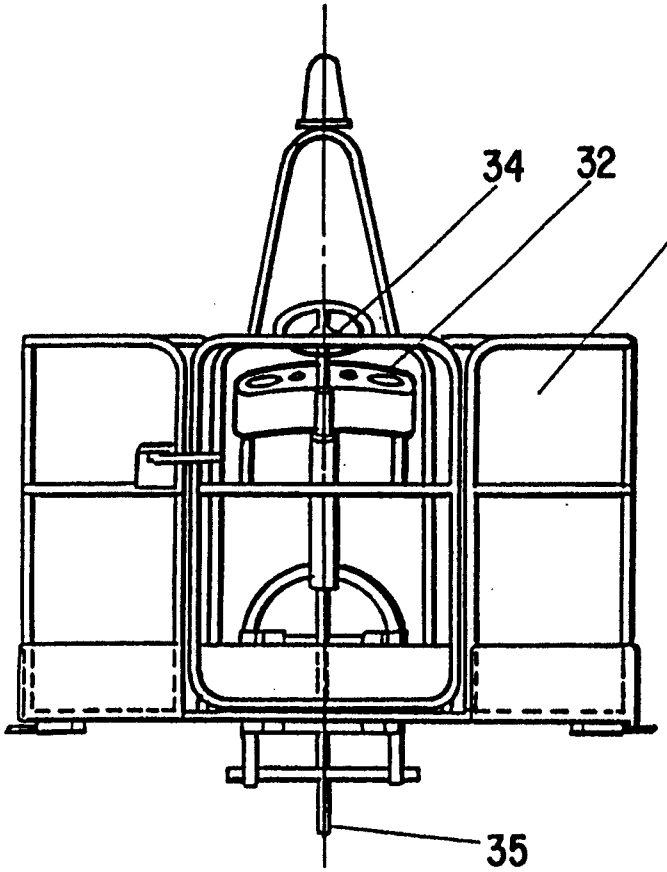
FIG. 6 is a plan view of the aerial platform.
Figure 9:
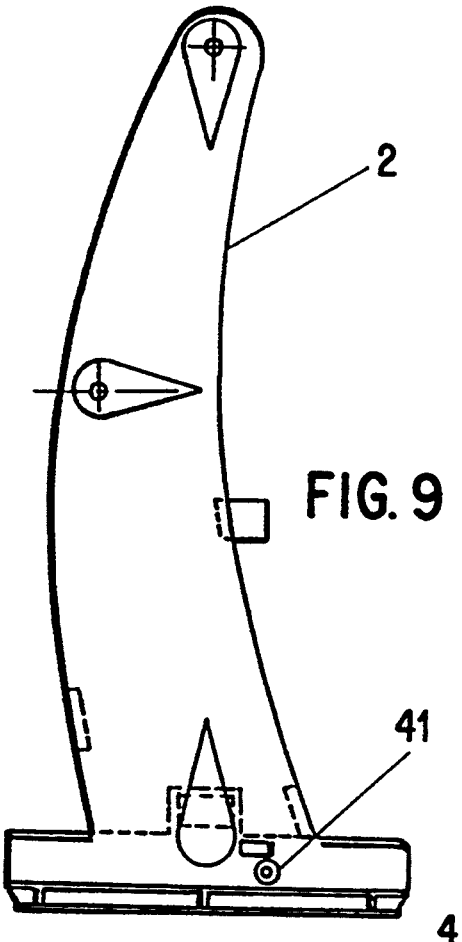
FIG. 9 is an elevated side view of a turret mounted revolving on a fixed bearing disc with respect to a platform fixed to the truck.

As illustrated in FIG. 2, when the machine is completely lowered onto the truck, the loading base of the platform 18 reaches a minimum height with respect to ground level, i.e. the height of the frame of the truck 1. For use when the machine is lowered, the driving position 33 of the platform 18 is provided with a steering wheel connected to a steering column 34, see FIGS. 6, 7 and 8. The end of the steering column 34 is fixed to a pinion 35 which engages with into a corresponding seat 36, FIGS. 2, 5 and 8. The seat 36 has comprises a coupling socket with a tapered edge connected to a mechanical transmission system which, only when the pinion 35 is engaged in the corresponding seat 36, allows the stabilizer arms 20 to return to the rest position and allows for the truck 1 to be moved, the driving wheels of the said truck being controlled by the steering wheel.

As illustrated in FIG. 8, a spring 37 cooperates with the steering column 34, the spring 37 pushing by reaction to compression the end 35 into the corresponding seat 36. A universal joint 38 connects the parts 34 and 39 of the steering column. A spring 40 maintains the coaxial status between the steering column parts 34 and 39 when the end 35 of the steering column is released from the seat 36, while still allowing the end 35 to be moved transversely as may be necessary for engagement in the seat 36, which seat 36 is provided with an entrance having a frustum tapered profile.

Figure 4:
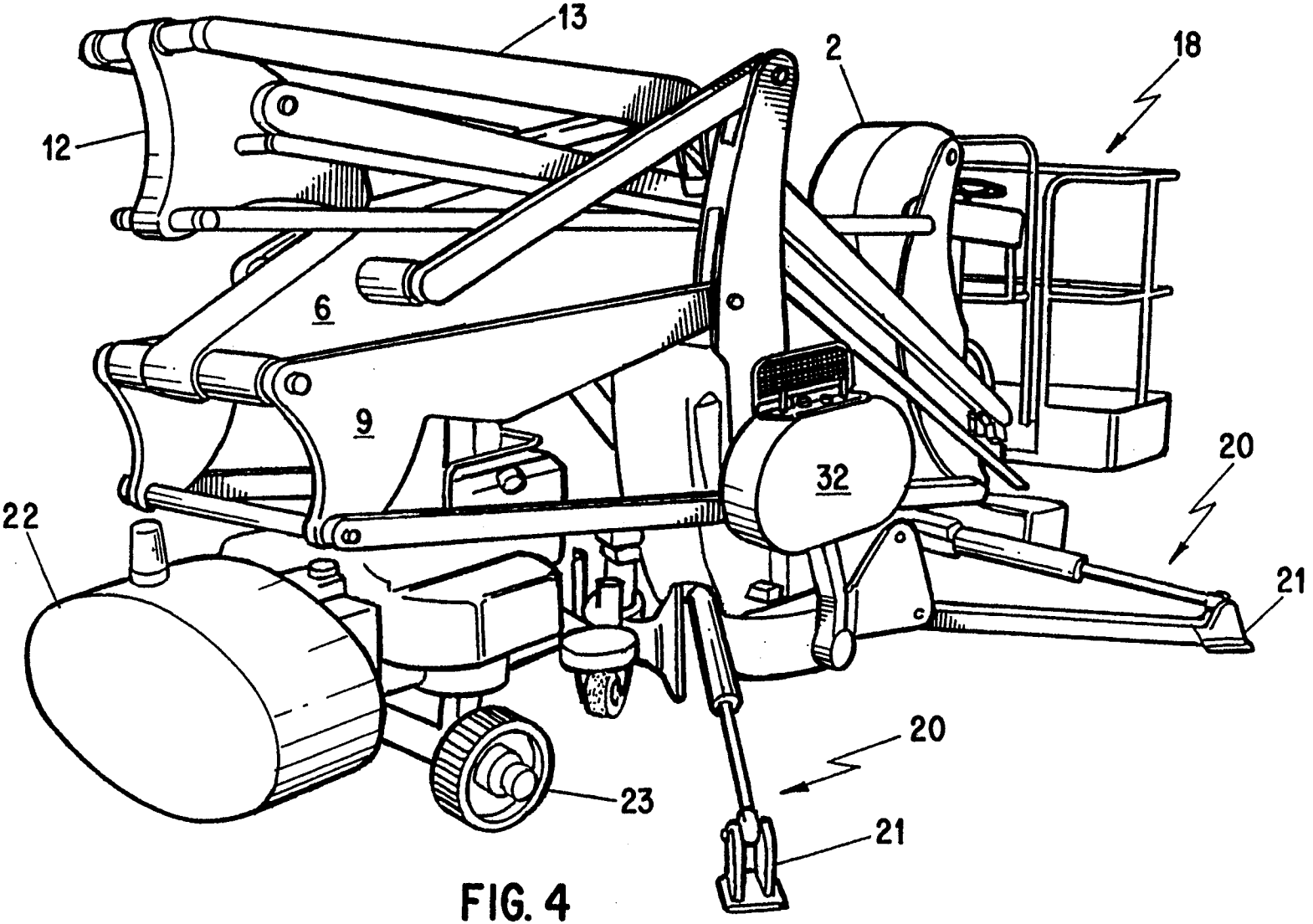
FIG. 4 is an axonometric view of the machine lowered onto the corresponding truck which has radial stabilizers.
Figure 10:
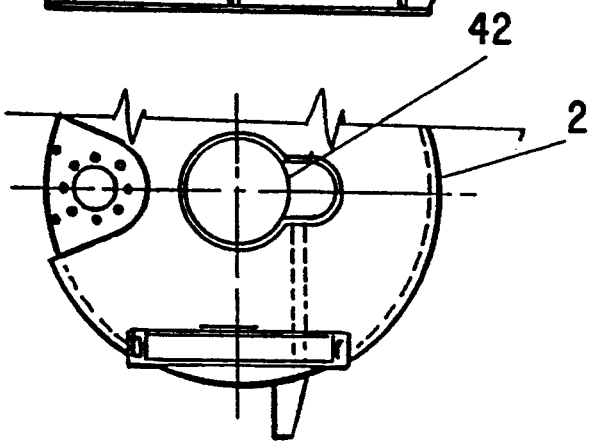
FIG. 10 is a top plan view of the turret of FIG. 9.
Figure 11:
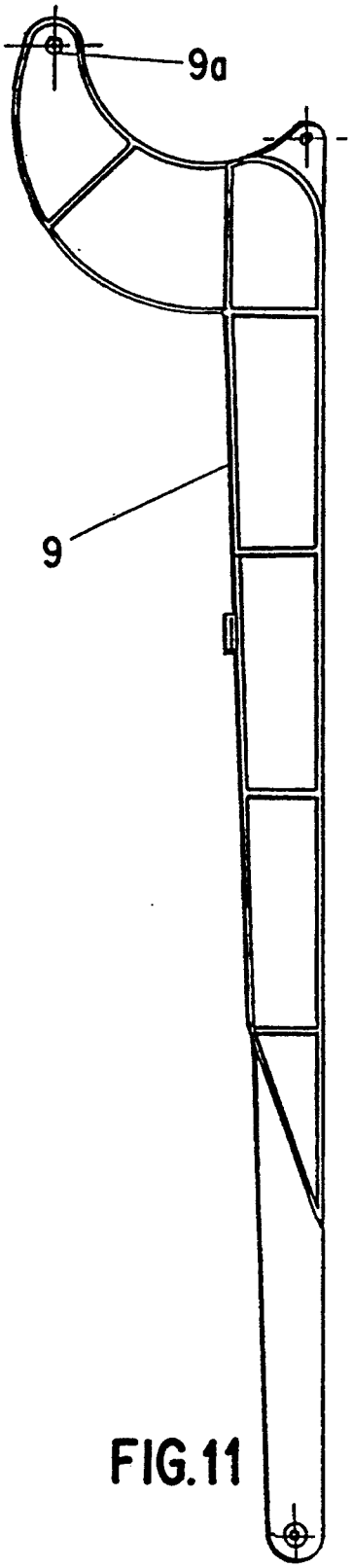
FIG. 11, in median vertical section, illustrates a lever that is part of the intermediate stage of the machine, hereunder called a radial lever.

The working of the machine is described herebelow:

When the machine is in a completely lowered position on the truck 1, see FIGS. 2 and 4, the stabilizers 20 are activated. Subsequently, the hydraulic jack 5, hinged at 41 to the base of the revolving turret 2, crossing its space 42, see FIG. 10 is activated. The opposite end of the jack 5, hinged at 43, with respect to the lifting arm 6, provides thrust to the crib 8. These parts comprise the mechanism of the first two stages of lifting.

The activation of a second hydraulic jack 10, see FIGS. 1, 3, hinged at 9*a*, sets into action the radial lever 9 which gradually passes from an almost horizontal rest position to an almost vertical position as shown in FIGS. 1 and 3. The tie rod constituted by the parallelogram 11 cooperates with the lever 9, which is hinged to the part 12, called a "counter-crib", to form the third lifting stage. The counter crib 12 is connected to the fourth stage which includes the end angled lever 13, shown in detail in FIG. 14, the end of which is hinged to the frame of the platform 18.

The bars 15 and 17 cooperate with the lever 13, the bars 15 and 17 being hinged to an intermediate return part 14, called a "balancing element" which provides for the articulation between lever 13 and bars 15, 17. The use of the balancing element 14 allows for the angled profile of the lever 13 which limits the space its occupies and allows the turret 2 to penetrate into the quadrilateral of the last lifting stage, connected to the platform 18, see FIG. 4, thereby allowing the loading base of the aerial platform 18 to be lowered to the height of the frame of the truck 1.

The advantage s that derive from the overall mechanical structure of the machine and from the quadrilateral geometrical shape of the levers that make up the lifting stages, can be summarized as follows:

- modular support truck which can be fitted with either hydraulic or electric motors, or internal combustion motors;
- minimum space necessary, particularly in height, when the machine is lowered onto the truck 1, thanks to the interpenetration of the various parallelograms which make up the groups of articulated levers;
- minimum space required, on the horizontal plane, when the machine is fully extended in height, thereby making it possible to bring the aerial platform 18 into very limited transversal spaces;
- minimum weight thanks to the tubular structure of the parts which make up the various lifting stages of the machine;
- possibility to use the machine in both closed and open environments;

considerable weight of the load to be lifted such as, for example, 300 Kg up to 20 mt of height;

minimum oscillation of the overall hinged structure even at maximum elevation, contained by the structure of the machine which, thanks to the minimum space taken up transversally, offers a better performance than the well known telescopic lifting machines;

finally, the machine according to the invention, without the truck, but provided with a base bearing plate, can be mounted on any kind of suitable motor vehicle.

I claim:

1. In a hoist machine for an aerial platform, having a base, a plurality of mutually articulated pantographic levers forming a plurality of stages, one of said levers being articulatedly connected to said base, a plurality of jacks connected to selected ones of said levers for extending said stages to raise said aerial platform to a working position and retracting said stages to lower said aerial platform to a rest position, said aerial platform being articulatedly connected to another of said levers, distal from said base when said stages are extended, the improvement wherein said base comprises truck means for moving said hoist machine along the ground, said truck means having first coupling means, and said aerial platform comprises driving means for controlling the movement of said truck means, said driving means having second coupling means, said first and second coupling means being releasably engageable for enabling said truck means to be controlled by said drive means when said aerial platform is in said rest position.

2. A hoist machine for an aerial platform according to claim 1 wherein said driving means comprises a steering column and said second coupling means is mounted on one end of said steering column, and said first coupling means comprises a seat for receiving said one end of said steering column.

3. A hoist machine for an aerial platform according to claim 2 wherein said steering column comprises an upper section, a lower section, and a universal joint disposed between said upper and lower sections for permitting said lower section to be pivoted relative to said upper section, and spring means mounted on said universal joint for resiliently urging said lower section into axial alignment with said upper section.

4. A hoist machine for an aerial platform according to claim 3 further comprising spring means connected to the upper section of said column, whereby compression of said spring means axially urges said steering column toward said first coupling means for engagement therewith.

5. A hoist machine for an aerial platform according to claim 4 wherein said seat has a frustoconical opening for guiding said second coupling means into axial alignment with said first coupling means during engagement therebetween.

6. A hoist machine for an aerial platform according to claim 1 wherein said stages are in the form of parallelograms of differing sizes and at least one of said stages is disposed within the perimeter of another of said stages when said stages are retracted for reducing the height of said hoist machine when said aerial platform is in said rest position.

7. A hoist machine for an aerial platform according to claim 6 wherein the bottom of said aerial platform is at the height of said truck when said stages are retracted.

8. A hoist machine for an aerial platform according to claim 1, further comprising stabilizer means, said stabilizer means comprising a plurality of projection means fixedly mounted on said truck, one arm means pivotally mounted on each of said projection means, and a jack means connected between each projection means and its respective arm means for pivoting said arm means away from said projection means to a first position in engagement with the ground for preventing movement of said truck and enabling pivoting of said arm means toward said projection means to a second position disengaged from the ground for permitting movement of said truck.

9. A hoist machine for an aerial platform according to claim 8 wherein said projection means has a longitudinal opening, said jack means being mounted to said projection means within said opening.

10. A hoist machine for an aerial platform according to claim 8 further comprising means for allowing said arms to be moved to said second position only when said aerial platform is in said rest position.

* * * * *